US006230473B1

(12) United States Patent
Rudolf

(10) Patent No.: US 6,230,473 B1
(45) **Date of Patent: *May 15, 2001**

(54) METHOD AND APPARATUS FOR PACKING STACKS OF FLAT ARTICLES

(75) Inventor: Hermann Rudolf, Adetswil (CH)

(73) Assignee: Ferag Verpakkingstechniek B.V., Soest (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/325,515

(22) Filed: Jun. 3, 1999

(30) Foreign Application Priority Data

Jun. 10, 1998 (CH) ..... 1258/98

(51) Int. Cl.[7] ..... B65B 11/58

(52) U.S. Cl. ..... 53/449; 53/66; 53/168; 53/399; 53/526; 53/589

(58) Field of Search ..... 53/168, 176, 399, 53/436, 449, 526, 528, 529, 530, 589, 504, 503, 66

(56) References Cited

U.S. PATENT DOCUMENTS

| | | | | |
|---|---|---|---|---|
| 3,643,396 | | 2/1972 | Togashi et al. | 53/24 |
| 4,691,502 | * | 9/1987 | Convey, Jr. | 53/529 |
| 4,831,809 | * | 5/1989 | Ballestrazzi et al. | 53/64 |
| 4,956,961 | * | 9/1990 | Janhonen | 53/176 |
| 5,299,410 | | 4/1994 | Freeman | 53/442 |
| 6,082,254 | | 7/2000 | De Vlaam . | |
| 6,085,487 | | 7/2000 | De Vlaam . | |

FOREIGN PATENT DOCUMENTS

| | | | |
|---|---|---|---|
| 31 40 291 | 4/1983 | (DE) | B65B/27/08 |
| 0 113 874 | 7/1984 | (EP) | B65B/27/08 |
| 0 940 341 A1 | 2/1999 | (EP) . | |

* cited by examiner

*Primary Examiner*—Peter Vo
*Assistant Examiner*—Hemant M. Desai
(74) *Attorney, Agent, or Firm*—Rankin, Hill, Porter & Clark LLP

(57) ABSTRACT

Stacks (2) of flat articles supplied in a serial stack stream are wrapped with a film (3) in a first packing step so the film (3) covers the top, bottom and two vertical sides of each stack and projects beyond both sides of the covered stack sides. Packing of the film-wrapped stacks (2.3, 2.4) is finished in a second packing step at a strapping/welding position. Depending on the stack height (d.1, d.2), stacks (2.3) having a height (d.1) greater than a predetermined limit stack height are strapped and stacks (2.4), whose height (d.2) is equal to or smaller than the limit stack height, film areas (3.1) projecting beyond the top and bottom of the stack are welded together, strapping being suppressed or performed simultaneously with the welding operation.

17 Claims, 3 Drawing Sheets

METHOD AND APPARATUS FOR PACKING STACKS OF FLAT ARTICLES

FIELD OF THE INVENTION

This invention is in the field of packing technology and relates to a method and an apparatus for packing serially supplied, substantially parallelepipedic stacks each consisting of a plurality of superimposed, flat articles, such as, e.g., newspapers or magazines. It is possible also to pack other, substantially parallelepipedic articles with the method and apparatus according to the invention.

BACKGROUND OF THE INVENTION

For dispatch purposes, newspapers and magazines are usually stacked, the stacks being strapped at least once with a strap or band and they may be enveloped or wrapped with a film or foil prior to strapping. Stacks packed in this way are stable and easy to handle as a result of the strapping and, due to the film wrapping, at least the outermost products are protected against environmental influences such as moisture or dirt and also against mechanical damage. Depending on the stack stability and on the size of the stacked articles, single or multiple strapping is used, the multiple strapping consisting of at least two parallel straps or of at least two straps at right angles to each other.

For wrapping and strapping serially supplied stacks, as well as of other substantially parallelepipedic articles, the most varied methods and apparatus are known and these are, e.g., described in European patent publication numbers EP-0894721, EP-0890509, and EP-0949341. With most of these methods and apparatus, it is possible to produce, with short cycle times, adequately stable stack packs, provided that the heights of all the supplied stacks falls within a predetermined range and in particular provided that none of the stacks has a height smaller than a predetermined minimum height.

The minimum stack height limitation may have various reasons. The stacked products can, e.g., be so bendable or flexible that in a small stack, they are bent by a taut strap so that the strap loosens and the pack becomes unstable. If the strap is welded together on a perpendicular lateral face of the stack, in a small stack, the weld point can be higher than the stack, so that taut strapping cannot be obtained.

For dispatch purposes, predetermined numbers of newspapers and magazines are made ready by stacking and packing and a dispatch unit usually comprises a plurality of standard packs (stacks with a standard height) and, e.g., one top pack (smaller than the standard pack). Such top packs can contain a very small number of magazines or newspapers or even a single magazine or newspaper. Due to the aforementioned limitation to the stack height in the known strapping machines, the top packs may have to be supplied to a separate apparatus, such that not only additional wrapping/strapping apparatus but also additional conveying paths and switch points are required. Because in most cases it is important that standard and top packs are discharged from the packaging process in the same order in which the stacks forming these packs were supplied, the allocation of the stack flow to different packing machines and the bringing together of the packed flow after packing requires complicated automatic control or necessitates manual reorganization.

SUMMARY OF THE INVENTION

An object of the invention is to provide a method of forming serially supplied stacks of flat articles such as newspapers or magazines into stable packs in which the supplied stacks can have any height between a standard height and a very small height. This means that, with the inventive method, it is possible to pack without difficulties also stacks comprising, e.g., a single newspaper or magazine. The method according to the invention is usable without modifying the stack sequence in a stack flow and with cycle times no longer than the cycle times expected in known stack packing methods. A further object of the invention is to provide an apparatus for performing the method.

According to the inventive method, in a first step a foil or film is placed around each of the serially supplied stacks and is closed to form a wrapping or envelope using a per se known method. In a second step, enveloped or wrapped stacks having a greater stack height are pressed and strapped, whereas enveloped or wrapped stacks having a smaller stack height, and therefore not being able to be packed to form a stable pack by strapping, are finished by side welding the film wrapping instead of, or in addition to, strapping.

To permit the lateral or side welding of the film wrapping for stacks with a smaller stack height, the film material used for wrapping is wider than the corresponding dimension of the stack and the film is placed and closed around the stacks such that top, bottom and two vertical sides of the stack are covered by the film and the film projects from the stack on both sides. In the side-welding step applied to small stacks, the film parts projecting beyond the top and bottom of the stack are joined together. It will be understood that, in this context, the foil or film material can be any form of sheet material, commonly plastic or plastic coated, which is capable of being wrapped around articles and welded or otherwise adhered to itself, examples of such material being known from the prior art.

With the inventive method, larger packs (particularly standard packs, but optionally also larger top packs) wrapped with a film and strapped with at least one taut strap, advantageously perpendicular to the film wrapping, as well as small packs (top packs) wrapped with a film covering the top, bottom and two vertical stack sides and being closed over the two other vertical stack sides by at least spot welds, are produced in a stack-height dependent sequence. In both larger and smaller packs, the stacked articles are not only protected, but are also held in the stack, held in one direction by the film and in the other direction either by a strap or by the side-welded film.

The apparatus for performing the method permits in the same stack position (strapping/welding position) and without any specific setting, welding laterally protruding portions of the film wrapper (side-welding) and/or strapping. The apparatus according to the invention comprises means for wrapping serially supplied stacks with a film, means for pressing wrapped stacks and means for strapping wrapped stacks, the pressing means being equipped as welding means for the side-welding operation, at least the strapping means and the welding means being controlled depending on the stack height of each supplied stack.

For controlling the stack height-dependent packing step, the apparatus is equipped with sensor means for detecting the height of a stack to be packed, or with means for supplying suitable data from a central computer to the apparatus.

BRIEF DESCRIPTION OF THE DRAWINGS

The method and apparatus according to the invention are described in greater detail hereinafter in conjunction with the attached drawings, wherein.

DETAILED DESCRIPTION OF PREFERRED EMBODIMENTS

Figure 1:
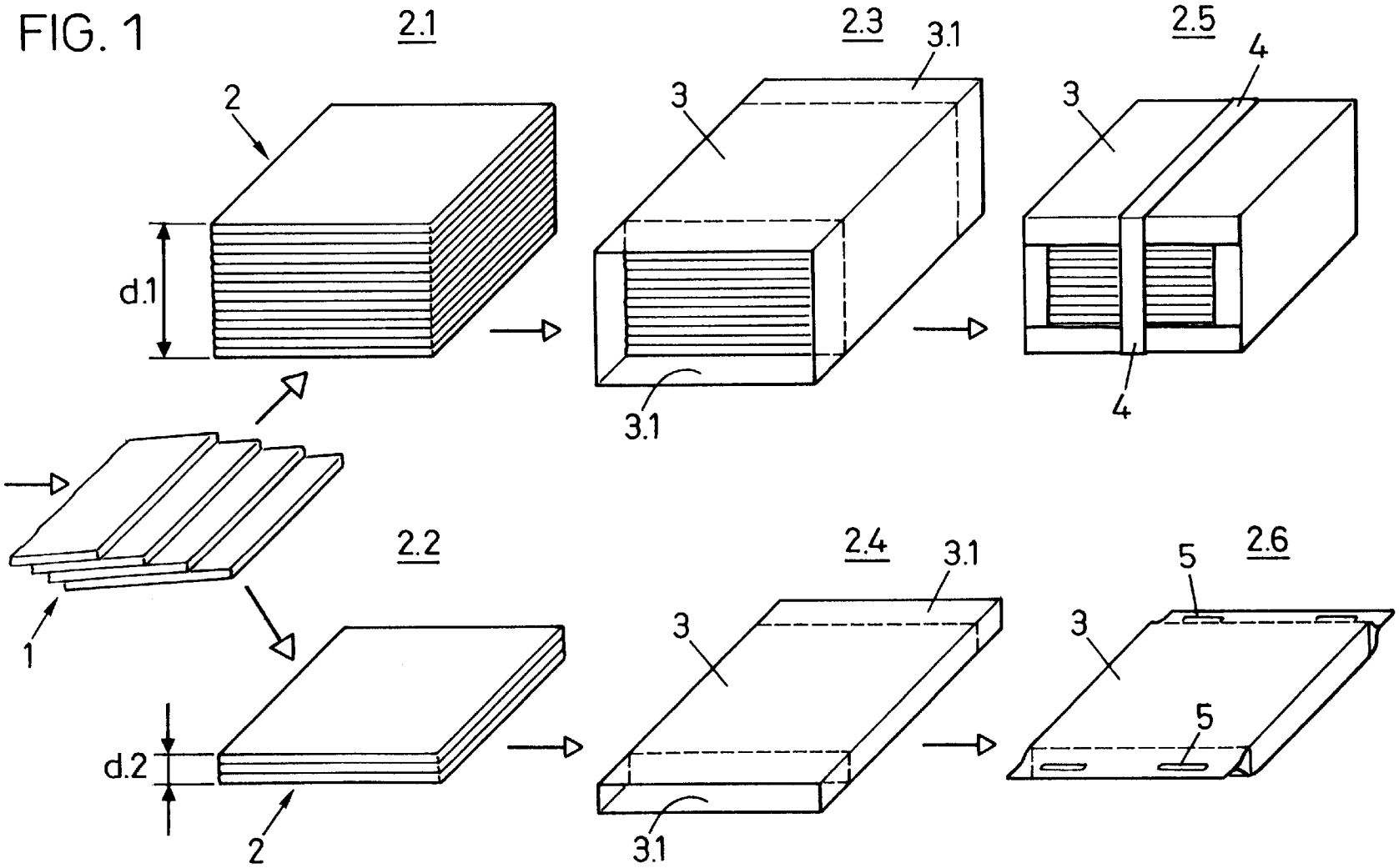
FIG. 1 schematically shows a sequence of successive steps for packing a larger and a smaller stack of newspapers or magazines in accordance with the inventive method.

FIG. 1 shows the successive steps in which newspapers or magazines or other flat articles are supplied, e.g., in a scale or flake stream 1, are stacked into stacks 2 with different heights d.1 and d.2 and then are packed according to the inventive method. In FIG. 1 the steps (2.1, 2.3 and 2.5) for large stacks are shown at the top and the steps (2.2, 2.4 and 2.6) for small stacks are shown at the bottom. This may awaken the impression that stacks of different heights are conveyed on different paths and are packed in different apparatus. However, in the inventive method this is not the case. Instead, all the stacks are conveyed and packed on the same conveying path in a continuous sequence and the height-dependent packing step (strapping and/or side welding) is performed both for large and small stacks in the same apparatus part, i.e., in the same strapping/welding position and with substantially the same cycle time. As a result, the speed of the stack or pack flow remains independent of the number of stacks having to undergo one or another height-dependent packing treatment. This uninterrupted stack or pack sequence represents an important advantage of the method according to the invention.

FIG. 1 shows on the left a stream of flat articles, e.g., a scale stream 1 of newspapers or magazines. From this stream 1, e.g., for dispatch or storage purposes, stacks 2.1 and 2.2 are produced, and these stacks have the most varied heights d.1 and d.2, particularly a standard height and very small heights. Stacks 2 are wrapped or enveloped with a weldable film or film 3 in a first packing step such that the film covers the top, bottom and two vertical sides of the stack and projects on two sides beyond the stack (stacks 2.3 and 2.4).

In a further packing step, film-wrapped stacks 2.3 having a stack height greater than a predetermined limit stack height are, e.g., strapped with a strap 4 and film-wrapped stacks 2.4 having a height which is the same as, or smaller than, the limit stack height are side-welded, i.e., the film areas 3.1 projecting beyond the top and bottom of the stack on both sides are welded together. In this second packing step, strapped, film-wrapped packs 2.5 or laterally welded, film-wrapped packs 2.6 are obtained.

The welding of projecting film areas 3.1 can extend over the entire stack side or, as shown in FIG. 1, can comprise a plurality of spot welds 5.

It is advantageous to use welding heads which can be lowered toward a surface supporting the stack for the welding step. In such a case, the projecting film areas 3.1 are to be dimensioned such that they are wider than the limit stack height at least by the desired seam width.

The film wrapping preceding the strapping/welding step can, e.g., be carried out when conveying the stack into the strapping/welding position. This means that each stack on entering the strapping/welding position is conveyed against the wrapping film extending in the form of a curtain and displaces the film curtain such that the film can be closed on the rear stack side when the stack is positioned in the strapping/welding position. In such a case, the film wrapping is parallel to the conveying direction and the strapping is advantageously a transverse strapping (perpendicular to the conveying direction). It is also conceivable for the stacks to be strapped prior to wrapping, e.g., perpendicular to the wrapping, and to strap them parallel to the wrapping and at right angles to the first strapping in the strapping/welding position.

It is also possible for the film wrapping to be produced in a wrapping position which is spaced from the strapping/welding position. The wrapped stacks are then conveyed from the wrapping position into the strapping/welding position and can also be turned between the two positions by 90° relative to the conveying direction. For such a case also, it is conceivable for the strapping position, also equipped as a welding position, to be one of two strapping positions so that, in each of these strapping positions, one part of a crosswise strapping is produced.

Figure 2:
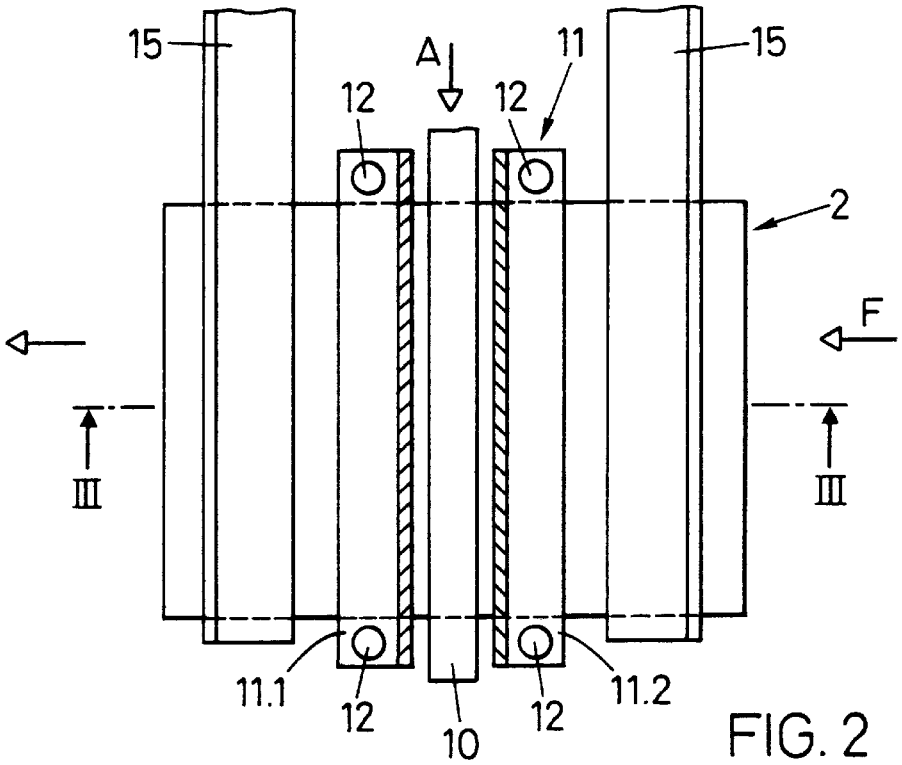
FIGS. 2 and 3 are respectively a top plan and a side elevation of parts of an embodiment of an apparatus in accordance with the invention.
Figure 3:
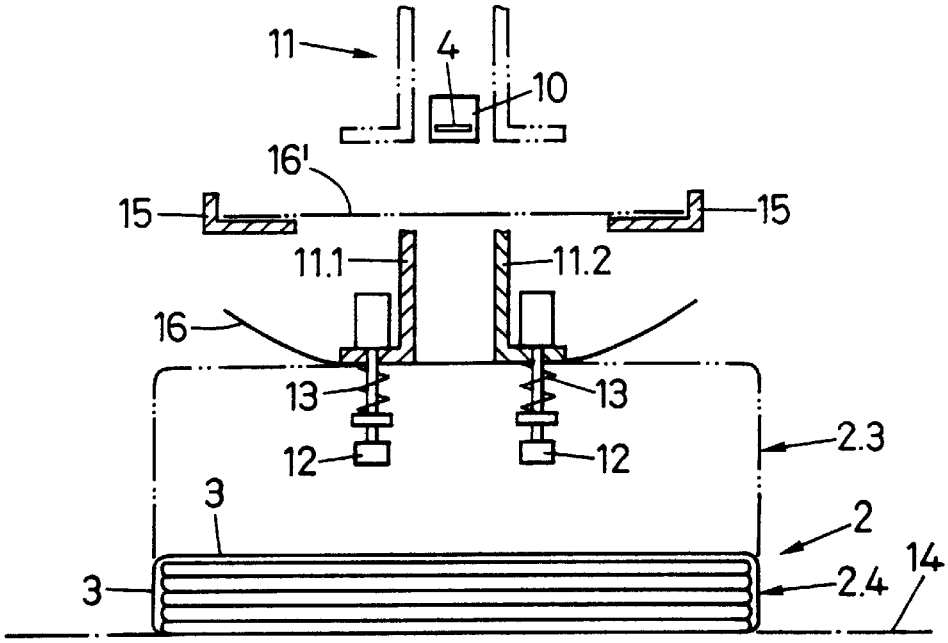

FIGS. 2 and 3 show a first embodiment of the inventive apparatus in a plan view (FIG. 2) and in section (FIG. 3, along section line III—III in FIG. 2). The apparatus is used for strapping a film-wrapped stack and/or for side welding the wrapping film along the stack sides oriented parallel to the conveying direction F. FIGS. 2 and 3 show a film-wrapped stack 2 (film wrapping parallel to the conveying direction F) in a wrapping/welding position, FIG. 3 showing with continuous lines a stack 2.4 having a small stack height and with interrupted lines a stack 2.3 having a larger stack height.

The apparatus further comprises conveying means (not shown) for conveying stacks 2 to the strapping/welding position and for conveying away packs in the conveying direction F and wrapping means for wrapping the stacks 2 with a film 3. The stacks are wrapped with film, parallel to the conveying direction, in a preceding or upstream apparatus part, or in the shown apparatus part (strapping/welding position), e.g., by passing the stack through a film curtain and carrying the curtain along so that the curtain can be closed at the rear of the stack. All the apparatus parts relating to film wrapping are known per se and are therefore not shown in FIGS. 2 and 3.

As a strapping means 10 for transverse strapping (strapping at right angles to the conveying direction F),the apparatus, e.g., comprises a strap channel, in which a loop of a strapping strap 4 is positioned. Furthermore, the apparatus comprises pressing means 11, e.g., two pressing beams 11.1 and 11.2 movable upwards and downwards and positioned laterally of the strap position. These pressing beams are shown in continuous lines in FIG. 3 lowered onto the large stack 2.3 and in interrupted lines in a raised position. On the ends of the pressing beams 1 1.1 and 11.2, projecting laterally over a stack 2 to be packed, are welding heads 12 positioned so that, when pressing beams 11.1 and 11.2 are lowered, welding heads 12 are lowered on either side of the stack and, when they are lowered onto a stack with a height which is smaller than the limit stack height, they reach the stack-supporting surface.

Preferably, welding heads 12 are resiliently mounted on pressing beams 11.1 and 11.2 (e.g., by means of springs 13), such that in a sufficiently lowered state they are pressed against support 14 on which stack 2 is conveyed or against a corresponding, stationary counter member.

The apparatus may also comprise means for adding a cover sheet 16 to a stack 2 to be packed, particularly to a stack 2 to be strapped. These cover sheet addition means, e.g., comprise a two-part, channel-like cover sheet holder 15, to which a cover sheet 16 is supplied in the direction of the arrow A and from which cover sheet 16 is carried along and positioned on the stack and pressed against stack 2.3 by pressing beams 11.1 and 11.2 as they are lowered. In FIG. 3, the cover sheet being pressed against large stack 2.3 is shown with continuous lines and is designated 16, and in cover sheet holder 15 it is shown in interrupted lines and designated 16'.

Cover sheet holder 15 may also be located on pressing means 11 to be lowered against the stack together with the pressing means. A cover sheet ready in the cover sheet holder is then pressed against the stack by the strapping strap and is freed from the holder when the pressing means and cover sheet holder are raised after strapping.

Figure 4:
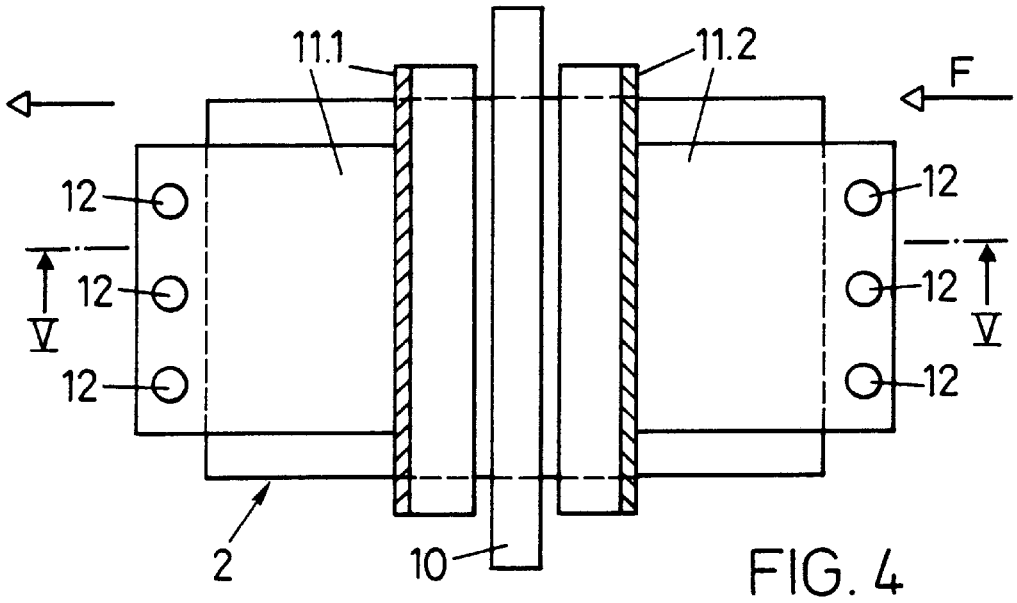
FIGS. 4 and 5 are a top plan and a side elevation of parts of a further embodiment of an apparatus in accordance with the invention.
Figure 5:
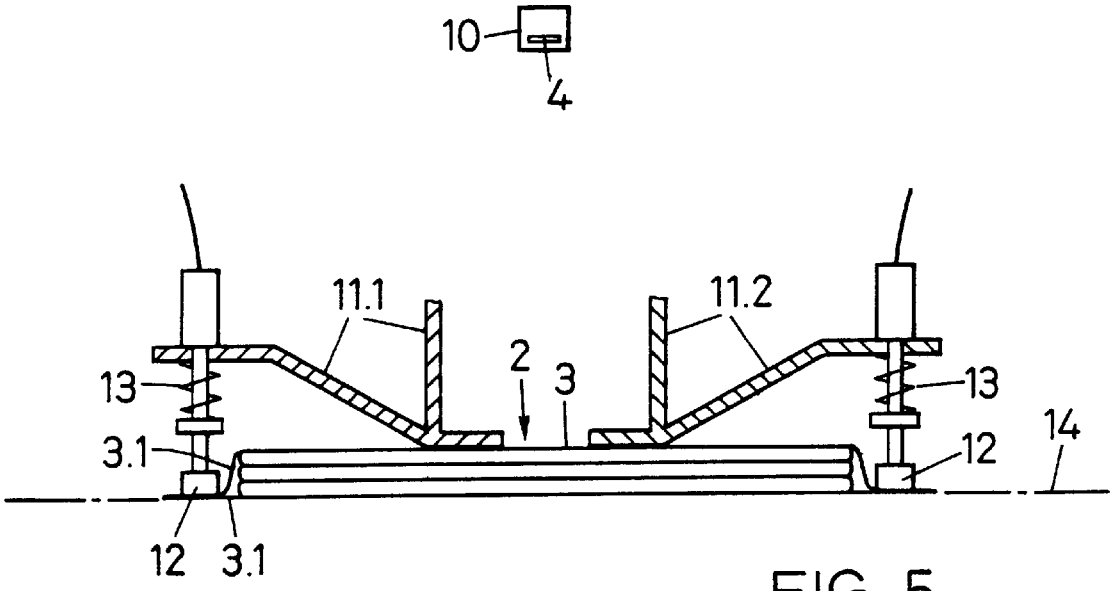

FIGS. 4 and 5 show another embodiment of the inventive apparatus in plan view (FIG. 4) and in section (FIG. 5, section along section line V—V in FIG. 4). The apparatus is used for strapping film-wrapped stacks 2 transversely to the conveying direction F or for side welding along the leading and trailing stack sides (film wrapping perpendicular to the conveying direction F). The apparatus according to FIGS. 4 and 5 differs from the apparatus according to FIGS. 2 and 3 in particular in that welding means 12 are located in the vicinity of the leading and trailing sides of stack 2. The apparatus also has no means for applying a cover sheet to stacks to be packed. The same parts are given the same reference numerals in all four drawings.

In FIG. 5 it is clearly visible how film areas 3.1 projecting over the top and bottom of the stack are pressed against supporting surface 14 and welded together by the welding heads.

What is claimed is:

1. A method for packing a plurality of stacks (2), each of said plurality of stacks being substantially parallelepipedic and comprising flat articles, said method comprising the steps of:

conveying all of said plurality of stacks in succession along a conveying path, said conveying path including a wrapping position and a strapping/welding position;

in the wrapping position, successively wrapping each of said plurality of stacks in a weldable film (3) so that a film wrapping defined by the film (3) covers a top, bottom and two vertical sides of each of said plurality of stacks and projects beyond the two vertical sides of each of said plurality of stacks;

detecting a height of each of said plurality of stacks; and, in the strapping/welding position, pressing each of said plurality of stacks and, for each of said plurality of stacks, if said stack has a detected height smaller than a predetermined limit stack height, closing said film wrapping by welding together wrapping portions projecting over the top and bottom of the stack and, if said detected height is larger than the predetermined limit stack height, strapping said stack.

2. The method according to claim 1, wherein the height (d.1, d.2) of the stacks (2) is detected with sensor means.

3. The method according to claim 1 wherein the projecting portions are welded together at a plurality of weld points (5).

4. The method according to claim 1, wherein the stacks are conveyed in a conveying direction (F) to the strapping/wrapping position, said conveying direction being generally perpendicular to said vertical sides.

5. The method according to claim 1, wherein the stacks are conveyed in a conveying direction (F) to the strapping/wrapping position, said conveying direction being generally transverse to the two vertical sides of each of said stacks.

6. The method according to claim 1, further comprising the step of providing a cover sheet (16) to stacks (2) to be strapped.

7. The method according to claim 1, wherein said articles are selected from the group consisting of newspapers and magazines.

8. The method according to claim 1, wherein said wrapping position and said strapping/welding position are provided at a single location.

9. The method according to claim 1, comprising the further step of strapping said stacks whose height is smaller than said predetermined limit stack height.

10. An apparatus comprising:

conveying means for supplying a serial stream of stacked flat articles and for conveying away a serial stream of packed flat article stacks;

wrapping means for wrapping the supplied stacks (2) with a film (3);

pressing means (11) for pressing wrapped stacks;

strapping means (10) for strapping pressed stacks;

welding means (12) for selectively welding together film areas (3.1) projecting beyond top and bottom edges of stacks;

sensor means for detecting a height of each stack;

means for comparing the detected height of each stack with a predetermined limit stack height; and, means for controlling the welding means in dependence upon said stack detected height so as to preclude welding when the stack detected height is larger than the predetermined limit stack height.

11. The apparatus according to claim 10, wherein said welding means (12) is mounted on said pressing means (11).

12. The apparatus according to claim 11, wherein said pressing means (11) comprises pressing beams (11.1, 11.2) movable upwardly and downwardly on either side of said strapping means (10), said welding means (12) being mounted on said pressing beams (11.1, 11.2) so that said welding means can be lowered against a stack-supporting surface (4) on opposite sides of a stack to be packed.

13. The apparatus according to claim 12, wherein said welding means (12) comprises a plurality of welding heads.

14. The apparatus according to claim 10, further comprising a cover sheet holder (15), said cover sheet holder being positioned so that said pressing means (11) extracts a cover sheet (16) carried by said cover sheet holder (15).

15. The apparatus according to claim 14, wherein said cover sheet holder (15) is firmly connected to said pressing means and is movable with said pressing means (11).

16. The apparatus according to claim 10, further comprising a cover sheet holder (15), said cover sheet holder being positioned so that said pressing means (11) extracts a cover sheet (16) carried by said strap.

17. The apparatus according to claim 10, further comprising means for controlling the strapping means (10) in dependence upon said detected stack height so as to preclude strapping when the detected stack height is smaller than the predetermined limit stack height.

* * * * *

UNITED STATES PATENT AND TRADEMARK OFFICE

CERTIFICATE OF CORRECTION

PATENT NO. : 6,230,473 B1
DATED : May 15, 2001
INVENTOR(S) : Rudolf

It is certified that error appears in the above-identified patent and that said Letters Patent is hereby corrected as shown below:

Column 1,
Lines 30-31, delete "European patent publication numbers EP-0894721, EP-08950509, and EP-0949341" and insert -- Swiss patent applications 01631/97, 01674/97, and 00504/98 --.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*